US005599427A

United States Patent [19]

Koivuranta et al.

[11] Patent Number: 5,599,427

[45] **Date of Patent: *Feb. 4, 1997**

[54] TWIN-WIRE WEB FORMER IN A PAPER MACHINE

[75] Inventors: Mauri Koivuranta, Kemi; Michael Odell, Jyväskylä , both of Finland

[73] Assignee: Valmet Corporation, Helsinki, Finland

[ * ] Notice: The portion of the term of this patent subsequent to Jun. 1, 2010, has been disclaimed.

[21] Appl. No.: 850,505

[22] Filed: Mar. 13, 1992

[30] Foreign Application Priority Data

Mar. 15, 1991 [FI] Finland ..... 911281

[51] Int. Cl.[6] ..... D21F 1/00

[52] U.S. Cl. ..... 162/301; 162/300; 162/352

[58] Field of Search ..... 162/300, 301, 162/348, 352

[56] References Cited

U.S. PATENT DOCUMENTS

| | | | |
|---|---|---|---|
| 3,832,282 | 8/1974 | Parker | 162/301 |
| 3,839,143 | 10/1974 | Suckow | 162/301 |
| 3,992,254 | 11/1976 | Lehtinen | 162/301 |
| 4,609,435 | 9/1986 | Tissari | 162/352 |
| 4,769,111 | 11/1988 | Nevalainen et al. | 162/300 |
| 4,790,909 | 11/1988 | Harwood | 162/300 |
| 4,988,408 | 1/1991 | Evalahti | 162/301 |
| 5,019,214 | 5/1991 | Meinecke et al. | 162/301 |
| 5,215,628 | 6/1993 | Koivuranta et al. | 162/301 |

FOREIGN PATENT DOCUMENTS

| | | | |
|---|---|---|---|
| 2053239 | 2/1991 | Canada . | |
| 0373133 | 6/1990 | European Pat. Off. . | |
| 0397430 | 11/1990 | European Pat. Off. . | |
| 0438681 | 7/1991 | European Pat. Off. . | |
| 0454989 | 11/1991 | European Pat. Off. . | |
| 885609 | 6/1990 | Finland . | |
| 885606 | 6/1990 | Finland . | |
| 3138133 | 3/1983 | Germany | 162/300 |
| 3910892 | 10/1990 | Germany . | |
| 9105797 | 7/1991 | Germany . | |
| 89/11000 | 11/1989 | WIPO | 162/301 |
| 9102842 | 3/1991 | WIPO . | |

OTHER PUBLICATIONS

"Twin–wire Forming Special Report", Pulp & Paper, Sep., 1992, pp. 130–161.

*Primary Examiner*—Karen M. Hastings
*Attorney, Agent, or Firm*—Steinberg, Raskin & Davidson, P.C.

[57] ABSTRACT

The invention is related to a twin-wire web former in a paper machine having a covering wire and a carrying wire which form a twin-wire forming zone with one another. A discharge opening of a headbox feeds a pulp suspension jet into the forming gap defined between said wires. The forming gap is immediately followed immediately by a forming shoe provided with a curved guide deck. A draining unit or units is/are provided after the forming shoe, before the first forming roll. The draining unit/units comprise(s) a press/support unit which guides the wire placed in contact with it as a straight run. The draining unit or units further comprise(s) a draining equipment provided with suction and foil equipment and placed opposite to the press/support unit, which draining equipment removes a substantial amount of water out of the web.

16 Claims, 4 Drawing Sheets

TWIN-WIRE WEB FORMER IN A PAPER MACHINE

FIELD OF THE INVENTION

The present invention is related to a twin-wire web former in a paper machine, comprising a covering wire and a carrying wire, which form a twin-wire forming zone with one another. At the beginning of twin-wire forming zone, a forming gap is defined between the two wires guided by breast rolls. The discharge opening of the headbox feeds a pulp suspension jet into the forming gap. The forming gap is followed, substantially immediately or after a relatively short straight joint run of the wires, by a forming shoe provided with a curved guide deck, after which there are at least two forming members. After the latter one of the forming members, the web is detached from the covering wire and passed on the carrying wire to the pick-up point.

BACKGROUND OF THE INVENTION

During the last 20 years, various manufacturers have introduced a number of web formers operating by the twin-wire principle, a review of said formers being published, e.g., in the journal *Pulp & Paper*, September 1982.

With increasing running speeds of paper machines, several problems in the web formation have been manifested with more emphasis. In the former of a paper machine, the phenomena that affect the fiber mesh and the water, which is still relatively free in connection with the fiber mesh, such as centrifugal forces, are, as a rule, increased in proportion to the second power of the web velocity. The highest web speeds of the present-day newsprint machines are of an order of 1200 m/min. However, newsprint machines are being planned in which a web speed of up to about 1700 m/min is aimed at.

In the assignee's FI Patent Application No. 904489 (filed Sep. 12, 1990), a twin-wire web former is described in the area of whose forming gap there is a first forming roll, on which the twin-wire zone is curved within a certain sector, which is followed by plane dewatering units or unit. These units comprise a press-support unit, which guides the wire that enters into contact with said unit as a straight run, as well as a dewatering equipment placed facing the press and support unit and provided with a suction and foil equipment, said dewatering equipment removing a substantial amount of water out of the web. The magnitude of the twin-wire turning sector placed in connection with the first forming roll is in the range of about 5° to about 120°, preferably within the range of about 35° to about 55°.

More particularly, the present invention is related gap formers in which the forming gap is defined between two breast rolls or equivalent turning members, such as turning bars, placed side by side, which breast rolls or equivalent do not operate as forming rolls, at least not to a substantial extent. After the breast rolls, the opposing wires that define the forming gap run as substantially straight runs, while approaching each other, onto the next forming member, which consists of a forming shoe provided with a curved guide deck.

With respect to the prior art related to the present invention, reference is made further to the U.S. Pat. No. 4,769,111 of A. Ahlstrom Corporation, to the assignee's FI Pat. Appl. No. 885609, as well as to the FI Patent Applications Nos. 884606 and 885607 of Valmet-Ahlstrom Inc., in which formers marketed under the trade mark "MB-Former" are described.

OBJECTS AND SUMMARY OF THE INVENTION

It is therefore an object of the present invention to further develop the inventive ideas stated in the above-mentioned FI Application No. 904489 and expansion of its field of application.

A further object of the invention is to provide a twin-wire gap former whose dewatering capacity and efficiency can be increased as compared with the prior art shoe-roll formers and with other, corresponding formers.

It is a further particular object of the invention to achieve the objectives mentioned above especially with slowly draining pulps, such as SC-pulps.

It is a further object to provide a gap former in which the increased dewatering capacity can be utilized as an increased web speed, especially in the case of fine papers, whose grammages are, as a rule, in the range from about 50 to about 200 g/m$^2$, while improving their formation.

In view of achieving the objectives stated above, those that will come out later, and others, in the present invention, after the forming shoe, before the first forming roll, a draining unit or units is/are provided, which unit/units comprise(s) a press/support unit, which guides the wire placed in contact with it as a substantially straight run. The draining unit or units comprise(s) a draining equipment provided with suction and foil equipment and placed opposite the press and support unit, which draining equipment removes a substantial amount of water out of the web.

In the invention, two prior art wire parts have been combined in a novel way, i.e. a prior art shoe-roll gap former and the above "MB-Former" (trade mark). By means of the MB-unit or units, a more intensive pulsating dewatering pressure can be applied to the pulp web, which pressure can be controlled and regulated better than in the prior art.

Due to the MB-unit or units fitted and located in accordance with the invention, in the gap formers subject of the invention, the formation can be improved and the dewatering capacity be increased. This is true especially with slowly draining pulps, such as SC-pulps. Owing to the increased dewatering capacity, e.g. in the case of fine papers, it is possible to use higher speeds at the same time as the formation is improved.

With the prior art gap formers, the headbox flow rates used for fine paper are lower than about 200 liters per second per meter (l/s/m), and the machine speeds are lower than 1000 m/min with the grammage of about 80 g/m$^2$. In formers in accordance with the present invention, it is possible to increase the flow rate in the headbox and the machine speed, according to preliminary estimates, by from about 10 to about 30% from the values given above.

Owing to the dewatering intensified by means of an MB-unit or units, the former in accordance with the invention is suitable for use in particular with fine papers, which are run with relatively high headbox flow rates and with low pulp consistencies.

In the invention, when the web arrives at the MB-unit, its dry solids content is, as a rule, of an order of from about 2% to about 8%.

Owing to the MB-unit or units fitted in accordance with the invention, the former in accordance with the invention is also suitable for use for relatively thick paper qualities as well as for boards and for pulps whose dewatering is more difficult than average.

In this connection, it should be emphasized that, in respect of its construction and operation, the MB-unit applied in the invention differs substantially from such forming members used in a corresponding position at which the twin-wire zone is curved with a large curve radius so that the wire that remains outside is free and dewatering of the web takes place to a substantial extent also through the outer wire by the effect of the tightening pressure of the web p=T/R (T=tightening tension of outer wire per meter, R=curve radius of the forming member), said dewatering being aided by centrifugal forces.

The MB-unit employed in the invention is highly efficient in, in the web that is being formed, producing pressure pulses that disintegrate pulp flocks more efficiently than the pressure pulsation of prior-art forming shoes does.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
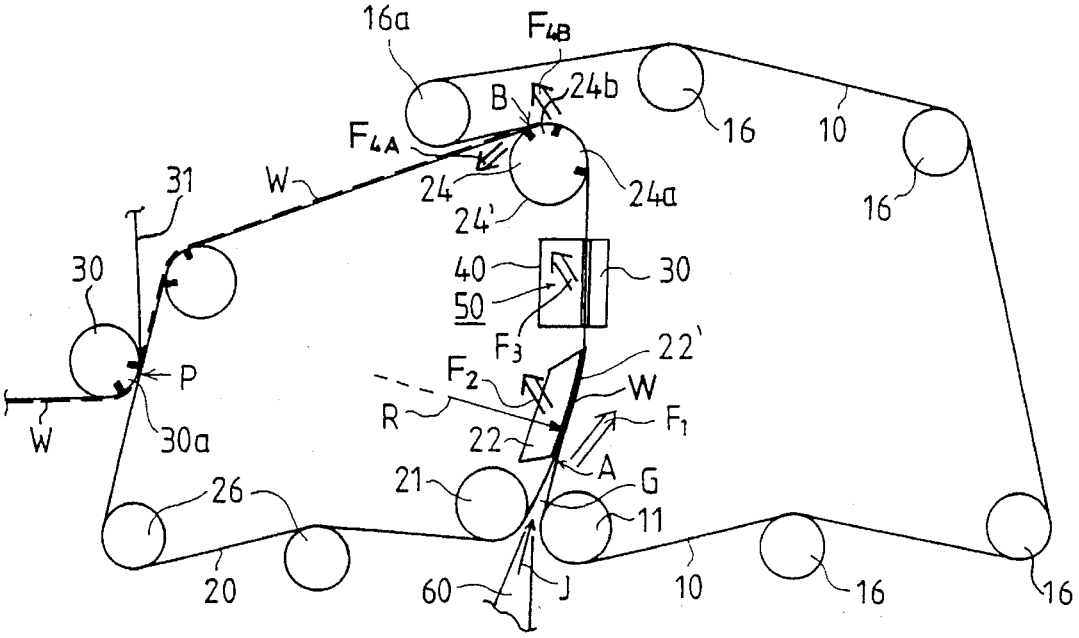
FIG. 1 is a schematic side view of an embodiment of the invention in which the twin-wire zone is vertical and the first forming roll is placed inside the loop of the carrying wire.

The formers shown in FIGS. 1 to 4 comprise a loop of the covering wire 10 and a loop of the carrying wire 20. The wires 10,20 have a joint run between the lines A and B (FIG. 1), which define the twin-wire forming zone in the former. The web W follows the carrying wire 20 after the twin-wire forming zone. The discharge part 60 of the headbox feeds the pulp jet J (FIG. 1) into the forming gap G defined by the wires 10 and 20, which gap is defined as determined by the relative positions of the breast rolls 11 and 21;21A.

The present invention is expressly concerned with a former in the area of whose forming gap G there is no forming member, such as a forming roll, that participates in the dewatering and web formation to a decisive and substantial extent.

Thus, in the formers subject of the invention, the forming gap G is defined between the wires 10,20 guided by two preferably solid-faced, breast rolls 11 and 21. After said breast rolls 11,21, the wires 10,20 have substantially straight runs that approach one another and that define the forming gap G.

Immediately after the forming gap G or after a relatively short straight run of the wires 10,20, in the invention, a forming shoe 12;22 follows which is provided with curved (curve radius R) guide deck, said shoe having a preferably open ribbed deck 12*a*;22*a* or, in an exceptional case, a solid deck 22', which is illustrated in FIG. 1.

The curve radius R of the forming shoe 12;22 is quite large, being usually in the range of R=from about 2.5 to about 6.0 m. Owing to the curvature R of the forming shoe 12;22, water is drained to a substantial extent in the direction of the arrow $F_1$ through the outer wire 10;20 and also towards the forming shoe 12;22 in the direction of the arrow $F_2$ if the shoe has an open ribbed deck 12*a*;22*a*, possibly further aided by negative pressure.

Figure 3:
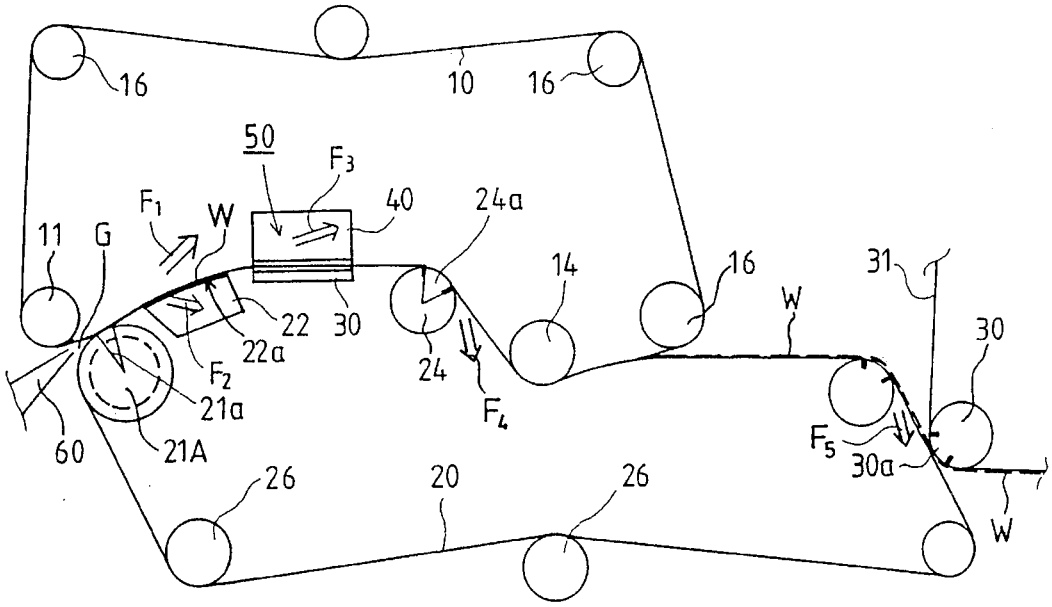
FIG. 3 shows such a horizontal version of the invention in which the forming shoe and the first forming roll are substantially in the same plane and the breast roll of the lower wire is a suction roll that is provided with a suction zone and with a perforated mantle.

In FIG. 3, a version of the invention slightly different from the above is shown, in which the breast roll of the lower wire 20, which is at the same time the carrying wire, is a forming-breast roll 21A provided with an open mantle and possibly also with a narrow suction zone 21*a*. The suction zone 21*a* is placed in the area of the forming gap G and, likewise in this embodiment, in the area of the roll 21A there is no significant twin-wire turning sector. If there is a turning sector, the sector is quite short, as a rule in the range of from about 5° to about 20°.

As an important dewatering and support unit, the twin-wire formers shown in FIGS. 1 to 6 include a MB-unit 50. Two such units 50A and 50B are fitted one after the other in FIG. 5. The MB-unit 40 or units 50A and 50B comprise a dewatering equipment 40 and a press and support unit 30, between which the wires 10 and 20 and the pulp web W placed between them pass.

Figure 5:
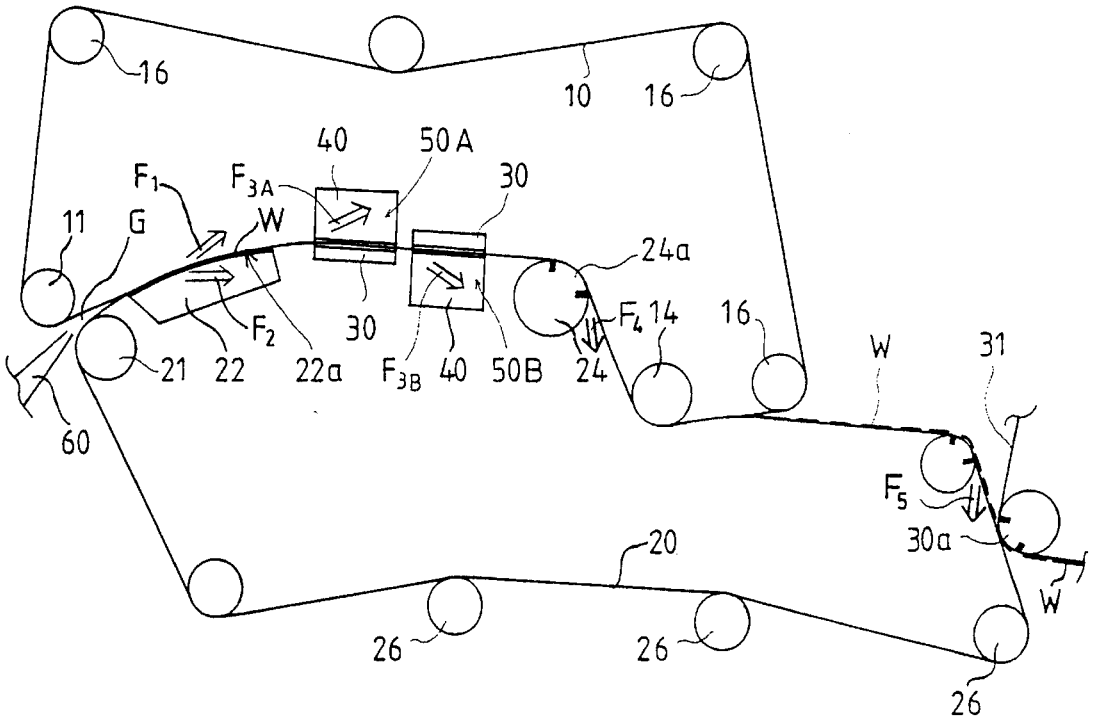
FIG. 5 shows an embodiment of the invention similar to that shown in FIG. 4, except that it is provided with two MB-units placed one after the other and operating in opposite directions as compared with one another.

In FIG. 5, the press and support unit 30 of the latter MB-unit B is placed above, so that it is a counter-unit and not a "support unit" proper. The press and support unit 30 included in the MB-unit 50, to be described in more detail later, guides the twin-wire zone as a straight run and presses it against the dewatering equipment 40. The dewatering towards the support unit 30 through the wire placed facing it is, as a rule, little, also with respect to dewatering taking place by the effect of the force of gravity. Thus, in connection with the MB-unit 50 or unit 50A,50B, the dewatering takes place toward the equipment 40 provided with suction and foil equipment in the direction of the arrow F3, or the arrows F3A and F3B.

An exemplifying embodiment of the construction of the MB-units 50;50A and 50B will be described in more detail later with reference to FIG. 7.

Figure 4:
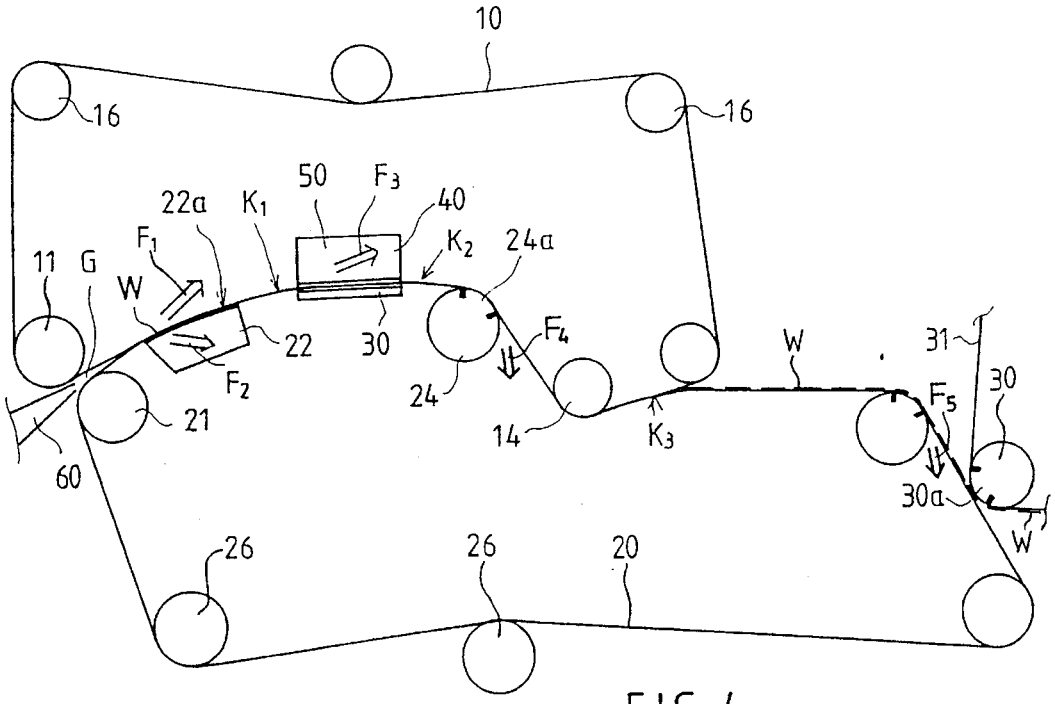
FIG. 4 shows an embodiment of the invention that is similar to that shown in FIG. 3, except that the breast roll of the lower wire is a normal breast roll with a smooth and solid mantle which does not participate in dewatering.

As is shown in FIGS. 1 and 3–5, after the MB-unit 50 or units 50A, 50B, a first forming roll 24 is placed inside the loop of the carrying wire 20, in the area of which roll 24 the run of the wires 10,20 is turned to curve towards the pick-up point (FIG. 1) or downwards (FIGS. 3 to 5). After the first forming roll 24, the web W proceeds to the line P (FIG. 1) or downwards (FIGS. 3 to 5). After the first forming roll 24, the web W proceeds to the line P (FIG. 1), at which it is detached from the carrying wire 20 by means of the pick-up fabric 31, which carries the web W further to the press section of the paper machine (not shown).

According to FIG. 1, in the first forming roll 24, which is placed inside the loop of the carrying wire 20 and which is provided with a mantle 24' with through perforations, there are two suction zones 24*a*, 24*b* placed one after the other. The latter zone 24*b* ensures that the web W follows the carrying wire 20, and the covering wire 10 is separated from the web W by means of the guide roll 16*a*.

Figure 2:
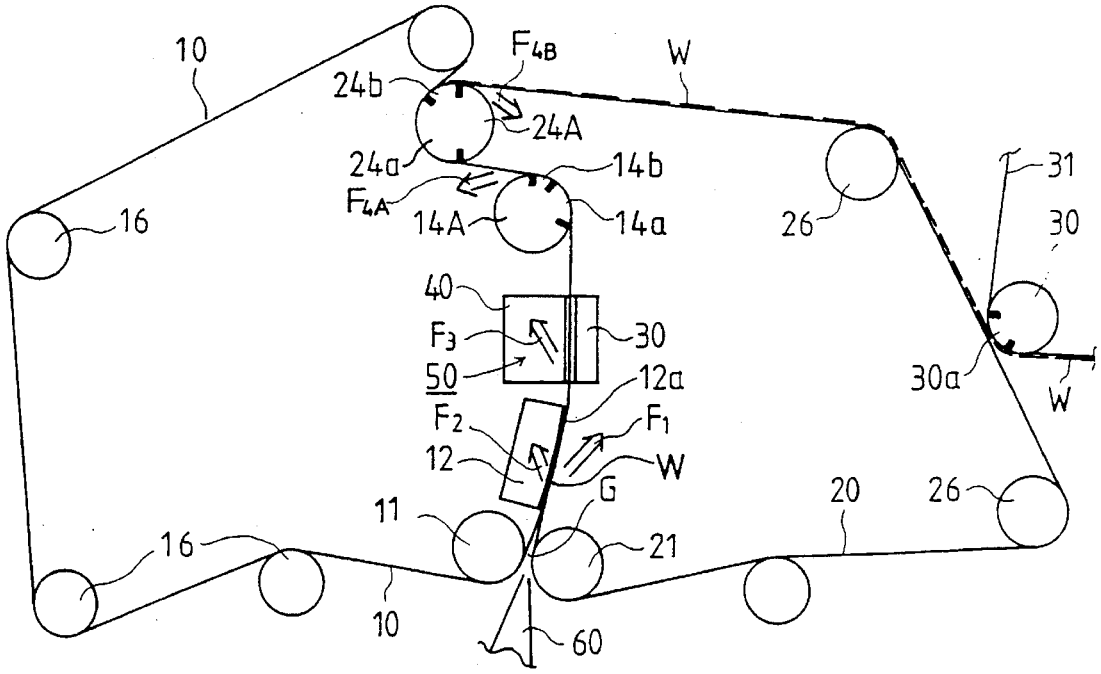
FIG. 2 shows, in a manner corresponding to FIG. 1, an embodiment of the invention in which the initial part of the twin-wire forming zone is vertical and in which, in the final part of the twin-wire zone, two forming rolls are used which are placed one above the other and side by side.

In FIG. 2, after the MB-unit 50, there are two subsequent forming rolls. The first forming roll 14A is placed inside the loop of the covering wire 10 and is provided with two subsequent suction zones 14*a*, 14*b*. The latter forming roll 24A is placed inside the loop of the carrying wire 20 and is provided with two suction zones 24*a* and 24*b* placed one after the other, the latter one of said suction zones 24*b* ensuring that the web W is separated from the wire 10 and follows the carrying wire 20.

In FIGS. 3, 4 and 5, there is a first forming roll 24 provided with a suction zone 24*a*, which roll 24 is placed inside the loop of the lower wire 20, which is, at the same time, the carrying wire. In the area of the forming roll 24, the horizontal run of the wires is turned downwards over about 40° to about 70°, whereupon the twin-wire zone is turned to a substantially horizontal level by means of a guide and/or forming roll 14 placed inside the loop of the covering wire 10. After this, the web W follows the substantially straight run of the carrying wire 20, and the covering wire 10 is separated from it.

Figure 6:
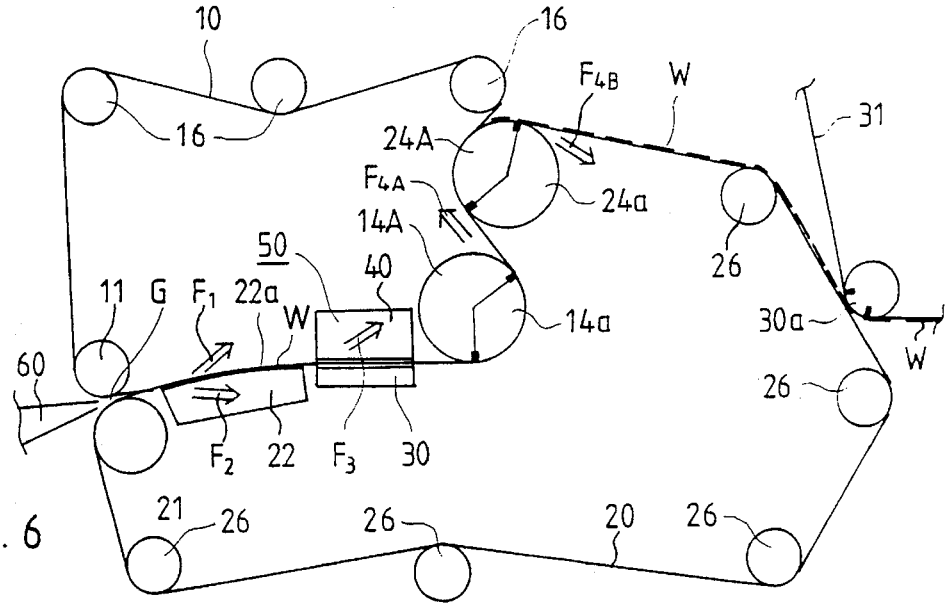
FIG. 6 shows an embodiment of the invention in which the initial part of the twin-sire zone is substantially horizontal, followed by two forming rolls, which have relatively large diameters, which are placed one above the other, and which are provided with suction zones.

FIG. 6 shows such a horizontal version of the invention in which the twin-wire forming zone, which starts after the forming gap G, has a substantially horizontal initial part. Inside the loop of the carrying wire 20, there is a forming shoe 22, which has an open ribbed deck 22*a*, through which an effect of negative pressure is applied through the wire 20 to the fiber web W that is being formed. The forming shoe 22 is followed by the MB-unit 50, in which there is the dewatering equipment 40 inside the loop of the covering wire 10 and the press and support unit 30 inside the carrying wire 20.

After the MB-unit 50, the twin-wire zone has a short horizontal joint run, after which said zone is guided and turned upwards by a first forming-suction roll 14A placed inside the loop of the covering wire 10, on whose suction zone 14*a* the run of the wires 10,20 is turned over an angle of more than 90° as upwards inclined onto the second forming-suction roll 24A, on whose suction zone 24*a* the joint run of the wires 10,20 is turned into a substantially downwards inclined run. At the beginning of this run, the covering wire 10 is detached from the web W, which follows the run of the covering wire 20 to the pick-up point, at which the web W is transferred onto the pick-up fabric 31 on the suction zone 30*a* of the pick-up roll 30. The forming-suction rolls 14A and 24A are placed one above the other, and this pair of rolls 14A,24A operates, in view of the dewatering and the formation of the web W, in a way substantially equivalent to the first forming roll 24 described above.

Figure 7:
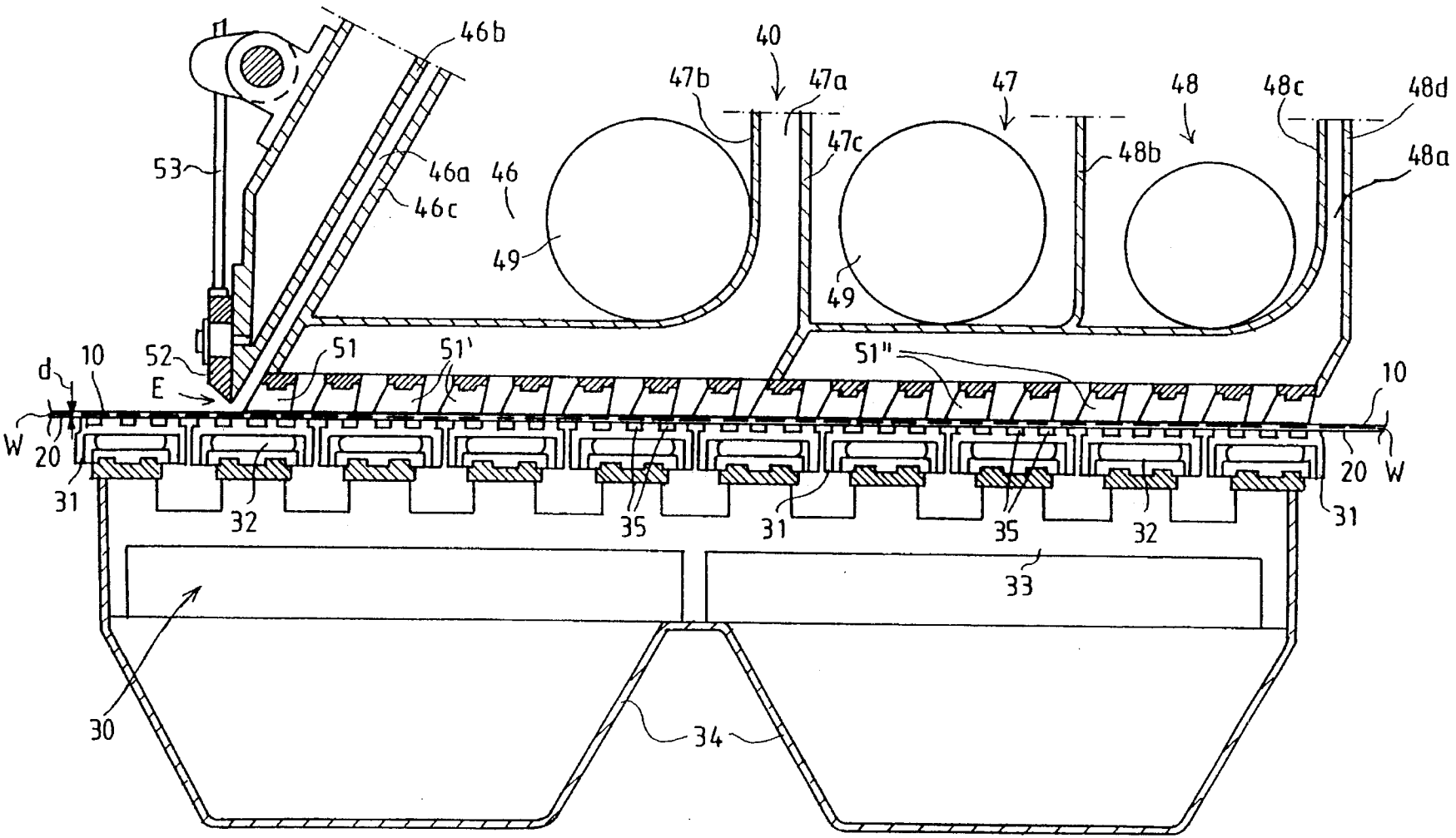
FIG. 7 shows a preferred embodiment of the MB-unit used in the invention.

FIG. 7 illustrates a MB-unit 50, which is included in the formers as shown in FIGS. 1 to 6 and which comprises a dewatering equipment 40 as well as a plane wire press and support unit 30 jointly operative with said dewatering equipment.

According to FIG. 7, the dewatering equipment 40 consists of an integrated combination of, as a rule, two to four (in the figures, three) suction and water collecting chambers 46,47,48, in which combination the different chambers are separated from one another by partition walls 47*b* and 48*b*. In each chamber 46,47,48, there is an air opening (not shown) that communicates with a suction source and an outlet water duct 49. The water collecting duct 46*a*, which belongs to the first suction chamber 46, is formed between the beam 46*b* and the guide plate 46*c*. At the lower end of the duct 46*a*, there is a transverse foil doctor 51 and a rib 52 which can be set by means of adjusting spindles 53, said doctor 51 and rib 52 forming a gap E, which extends across the width of the former and which can be regulated locally and through which the water pressed out of the pulp layer W placed between the wires 10 and 20 flows into the first chamber 46.

The foil doctor 51 in the equipment 40 shown in FIG. 7 is followed by a number of similar foils 51' and 51", whose lower faces are at the same level. The foils 51' collect the water that is separated from the fiber mesh in the area of the first suction chamber 46, but underneath said chamber, which water is passed into the suction chamber 47 through the duct 47*a*, which is formed between the partition wall 47*b* and the guide plate 47*c*. In a corresponding way, the water collected by the next foils 51" is passed into the third suction chamber 48 through the duct 48*a*, which is formed between the rear wall 48*d* of the dewatering device and the guide plate 48*c*.

The duct 46*a* shown in FIG. 7 and the related foil doctor 51 and the regulating rib 52 form a suction-aided dewatering member. When relatively thick qualities are produced by means of the former at low speeds, the operation of the autoslice system should be aided preferably by means suction while the vacuum is preferably from about 6 to about 8 kPa. At this stage, the amount of dewatering directed upwards and partly also the magnitude of the vacuum that is produced can be affected by regulating the height of the gap E between the rib 52 and the foils 51.

In FIG. 7, the dewatering effect of the suction-aided dewatering member and of the related first suction chamber 46 is local, being limited to the proximity of the tip of the first foil doctor 51. The dewatering area of the second suction chamber 47 is wider, being determined by the number of the foils 51', which number is shown to be seven as an example in the embodiment depicted in FIG. 7. The effect of the foils 51' is based on joint operation with the wire support equipment 30 placed inside the lower-wire loop 20.

It is an important feature of the press and support unit 30 and of its operation that, by its means, in the area of the dewatering equipment 40, it is in the desired way possible to provide a successively increasing compression by the lower wire 20 applied to the web W that is being formed, by the effect of which compression the dewatering of the web W takes place primarily through the upper-wire loop 10 into the suction duct 47*a* and through it into the suction chamber 47. The operation of the third suction chamber 48 is analogous to the second suction chamber 47.

The negative pressure that prevails in the second and the third chamber 47,48 shown in FIG. 7 is preferably considerably higher than that in the first chamber, i.e. from about 10 to about 20 kPa in the chamber 47 and from about 15 to about 30 kPa in the chamber 48, depending on the web material that is being produced. The beam members 31 of the press and support equipment 30 are supported on longitudinal support beams 33 by the intermediate of rubber hoses 32 pressurized with air, which support beams 33 are again supported by transverse box beams 34. The pressure effective in the hoses 32 can be regulated so that the load of the members against the lower wire 20 and the fiber mesh increases gradually in the running direction of the wires 10,20. Thus, the press and support equipment 30 is adjustable in loading. Furthermore, the compression pressure applied to the web and the distribution of the compression pressure in the running direction of the web are also adjustable as a result of the adjustable loading of the hoses. For instance, in the hoses 32, quite a low pressure is used, for example from about 10 to about 50 cm $H_2O$, in which case a very gentle compression is applied to the web W that is in the stage of formation, and the dewatering pressure is self-adjusted. The face of the members in the equipment 30 is provided with transverse grooves 35 extending across the entire width of the wire 20, which grooves also permit slight dewatering through the lower wire 20, and whereby micro-turbulence that improves the formation of the web W is produced.

In FIG. 7, the dewatering process goes on in the area between the line of incidence of the upper face of the web and the profile bar 52, where a water layer is formed on the inner face of the upper wire 10, which layer is gathered in the wedge-shaped space between the wire 10 and the profile bar 52 and in the subsequent gap E between the profile bar 52 and the foil rib, through which gap E the water is forced through the duct 46*a* into the first chamber 46 in the dewatering equipment, either by the effect of its kinetic energy and/or by the effect of the vacuum present in the chamber. The bar 52 can be positioned in the vertical direction by means of regulation devices 53, whereby it is possible to regulate the amount of water and possible also the amount of air that enters into the duct 46*a*. Said adjustments both in respect of the angle d of incidence between the wires 10 and 20 and of the gap that passes into the duct 46*a* and in respect of the pressure applied to the support system, of course, depend on the paper or board quality that is produced.

In some cases, the suction-aided system based on the used of a profile bar and shown in FIG. 7 can be substituted for by a construction in which the profile bar 52 is replaced by a roll, whose speed of rotation and height position, i.e. distance from the wire 10, are adjustably arranged.

A typical feature of the MB-units 50;50A shown in FIGS. 3 to 6 is that the press and support unit 30 is placed underneath and the dewatering equipment 40 that comprises a suction and foil equipment is placed above, in which case the unit 30 substantially prevents dewatering of the web taking place by the force of gravity downwards through the carrying wire. In FIG. 5, the first MB-unit 50B has been arranged to operate in the opposite direction.

In accordance with the denotations made into FIG. 4, after the dewatering stages (arrows $F_1$ and $F_2$) taking place on the forming shoe 22, the dry solids content $k_1$ of the web before the MB-unit 50, the dry solids content $k_2$ of the web is as a rule in the range of $k_2$=from about 7 to about 13%, and at the end of the twin-wire zone, the dry solids Content $k_3$ of the web is, as a rule, in the range of $k_3$=from about 10 to about 10%.

An example of a paper manufactured in accordance with the invention is fine paper whose grammage is about 80 g/m$^2$. In such a case, it is possible to use headbox flow rates of from about 200 to about 260 l/s/m and a web speed of from about 1000 to about 1300 m/min.

In the following Table A, the dewatering proportions in the twin-wire zones in the different embodiments shown in FIGS. 1 to 4 are shown, which proportions are, in the figures and in Table A, denoted with the references F1, F2, F3, F3A, F3B, F4, F4A, F4B. The dewatering proportions given in Table A are average values, and they may vary within certain limits depending on the paper quality, other operating parameters, and dimensioning details.

TABLE A

| | % | | | | | | | | | |
|---|---|---|---|---|---|---|---|---|---|---|
| Fig. | F0 | F1 | F2 | F3 | F3A | F3B | F4 | F4A | F4B | F5 |
| FIG. 1 | — | 35 | 15 | 40 | — | — | — | 4 | 3 | 1 |
| FIG. 2 | — | 35 | 15 | 38 | — | — | — | 9 | 1 | — |
| FIG. 3 | 25 | 30 | 15 | 23 | — | — | 4 | — | — | 1 |
| FIG. 4 | — | 30 | 20 | 35 | — | — | 11 | — | — | 2 |
| FIG. 5 | — | 30 | 15 | — | 25 | 25 | 2 | — | — | 1 |
| FIG. 6 | — | 35 | 15 | 38 | — | — | — | 9 | 1 | - |

By means of the MB-unit 50 or units 50A,50B, a pulsating and sufficiently strong dewatering pressure is achieved which disintegrates pulp flocks efficiently. The dewatering effect of the MB-unit 50 or units 50A and 50B can also be regulated better than in prior art.

It is typical of the MB-unit 50 or units 50A,50B that the wires 10,20 and the web W placed between the wires run through said units as a straight run, which provides the advantage that the wire 10,20 speeds can be equal, in which case, at this stage, when the dry solids content is already of an order of from about 2 to about 8%, an internal working arising from the difference in the wire speeds is no longer produced in the web, which working is typical, e.g., of the preceding forming shoe 22.

The former in accordance with the invention is suitable for use at relatively high web speeds, which are, as a rule in the range of from about 1000 to about 1700 m/min and primarily for qualities thicker than newsprint, from about 50 to about 200 g/m$^2$, from which good formation is required. Typical applications of the invention include gap formers operating in said speed range and used for the manufacture of fine paper or equivalent also out of slowly draining pulps, such as SC-pulps, at quite high headbox flow rates, which are typically in the range of from about 200 to about 250 l/s/m.

The examples provided above are not meant to be exclusive. Many other variations of the present invention would be obvious to those skilled in the art, and are contemplated to be within the scope of the appended claims.

What is claimed is:

1. A twin-wire web former in a paper machine, comprising a covering wire and a carrying wire which define a twin-wire forming zone with one another, said wires being guided by breast rolls, a forming gap being located at the beginning of said twin-wire forming zone, a headbox having a discharge opening, said headbox being structured and arranged to feed a pulp suspension jet from said discharge opening into said forming gap to form a web, a forming shoe which follows said forming gap in a running direction of the web and is arranged in said twin-wire forming zone, said forming shoe being provided with a curved, open guide deck, means for providing negative pressure in an interior of said forming shoe such that water is removed through both of said wires in the area of said forming shoe, a first forming roll arranged after said forming shoe in the running direction of the web, the web being detached after said first forming roll from said covering wire and passed on said carrying wire to a pick-up point, and a first and second draining unit provided after said forming shoe in the running direction of the web and before said first forming roll, each of said draining units comprising a press/support unit which guides an associated one of said wires placed in contact with it as a substantially straight run, each of said press/support units structured and arranged to apply an adjustable compression pressure to the web such that said press/support unit is flexible in loading, the distribution of the compression pressure in each of said press/support units also being adjustable in the running direction of the web, each of said draining units further comprising draining equipment provided with suction and foil equipment, said draining equipment placed opposite to said press/support unit in each of said first and second draining units such that said wires run between said draining equipment and said press/support unit, and each of said draining equipments structured and arranged to remove a substantial amount of water out of the web, and said first draining unit being arranged such that said press/support unit of said first draining unit is located inside a loop of said carrying wire and said draining equipment of said first draining unit is located inside a loop of said covering wire, and said second draining unit being arranged to operate in an opposite direction to said first draining unit such that said press/support unit of said second draining unit is located inside the loop of said covering wire and said draining equipment of said second draining unit is located inside the loop of said carrying wire.

2. The web former of claim 1, wherein said first draining unit is structured and arranged to provide from about 5% to about 50% of the total dewatering that takes place in said twin-wire zone.

3. The web former of claim 1, wherein said forming shoe and said forming roll are arranged substantially at the same level, a substantially horizontal joint run of said wires being located therebetween.

4. The web former of claim 3, wherein said carrying wire is arranged as a lower one of said wires in the area of the forming gap, a first one of said breast rolls guiding said carrying wire and being provided with a hollow face or with through perforations.

5. The web former of claim 4, wherein an interior of said first breast roll includes a suction zone arranged substantially in the area of the forming gap.

6. The web former of claim 4, wherein said web former is structured and arranged to provide that the speed of the web running in said web former is from about 1000 to about 1700 m/min.

7. The web former of claim 4, wherein said web former is structured and arranged such that the grammage is in the range of about 50 to about 100 g/m$^2$.

8. The web former of claim 4, wherein said headbox is structured and arranged to provide flow rates in said headbox in the range from about 200 to about 300 l/s/m.

9. The web former of claim 4, wherein said forming shoe is structured and arranged to dewater the web such that the dry solids content of the web before said first draining unit is the range from about 2% to about 8%.

10. The web former of claim 1, further comprising a second forming roll, said second forming roll being arranged after and above said first forming roll, said first and second forming rolls comprising suction rolls, said covering wire being separated from the web after said second forming roll.

11. A twin-wire web former in a paper machine, comprising a covering wire and a carrying wire which define a twin-wire forming zone with one another, said wires being guided by breast rolls, a forming gap being located at the beginning of said twin-wire forming zone, a headbox having a discharge opening, said headbox being structured and arranged to feed a pulp suspension jet from said discharge opening into said forming gap, a forming shoe arranged inside a loop of the carrying wire and following said forming gap in the running direction of the web, said forming shoe being provided with a curved guide deck, a first forming roll arranged after said forming shoe, the web being detached after said first forming roll from said covering wire and passed on said carrying wire to a pick-up point, a first and second draining unit provided after said forming shoe and before said first forming roll, each of said draining units comprising a press/support unit which guides an associated one of said wires placed in contact with it as a substantially straight run, each of said draining units further comprising draining equipment provided with suction and foil equipment, said draining equipment placed opposite to said press/support unit such that said wires run between said draining equipment and said press/support unit and said draining equipment structured and arranged to remove a substantial amount of water out of the web, and said second draining unit being arranged to operate in an opposite direction to said first draining unit such that said press/support unit of said first draining unit is located inside the loop of said covering wire or said carrying wire and said press/support unit of said second draining unit is located inside the loop of the other of said covering wire or said carrying wire from said press/support unit of said first draining unit.

12. The web former of claim 11, wherein said guide deck is open, further comprising means for providing negative pressure in an interior of said forming shoe, such that water is removed through both wires in the area of said forming shoe.

13. The web former of claim 11, wherein said forming shoe and said forming roll are arranged substantially at the same level, a substantially horizontal joint run of said wires being located therebetween.

14. The web former of claim 13, wherein said carrying wire is arranged as a lower one of said wires in the area of the forming gap, a first one of said breast rolls guiding said carrying wire and being provided with a hollow face or with through perforations, an interior of said first one of said breast rolls including a suction zone arranged substantially in the area of said forming gap.

15. A twin-wire web former in a paper machine, comprising a covering wire and a carrying wire defining a twin-wire forming zone with one another, said wires being guided by breast rolls, a forming gap located at the beginning of said twin-wire forming zone, a headbox having a discharge opening, said headbox being structured and arranged to feed a pulp suspension jet from said discharge opening into said forming gap, at least two forming rolls arranged in said twin-wire forming zone, the web being detached from said covering wire after the last one of said forming rolls in the running direction of the web and passed on said carrying wire to a pick-up point, a first and second draining unit provided after said forming gap and before a first one of said forming rolls in the running direction of the web, each of said draining units comprising a press/support unit which guides an associated one of said wires placed in contact with it as a substantially straight run, each of said draining units further comprising draining equipment provided with suction and foil equipment, said draining equipment placed opposite to said press/support unit such that said wires run between said draining equipment and said press/support unit and said draining equipment structured and arranged to remove a substantial amount of water out of the web, each of said press/support units structured and arranged to apply an adjustable compression pressure to the web such that each of said press/support units provides an adjustable load against the web and an adjustable distribution of the compression pressure in the running direction of the web, and said press/support unit of said first draining unit being arranged inside the loop of said covering wire or said carrying wire and said press/support unit of said second draining unit being arranged inside the loop of the other of said covering wire or said carrying wire.

16. The web former of claim 15, wherein said press/support unit of said first draining unit is arranged underneath and inside the loop of said carrying wire, said press/support unit of said second draining unit is arranged inside the loop of said covering wire and said draining equipment of said second draining unit is arranged inside the loop of said carrying wire.

* * * * *